United States Patent [19]

Ishikawa et al.

[11] 4,091,609

[45] May 30, 1978

[54] DIGITAL ELECTRONIC TIMEPIECE

[75] Inventors: Takehiro Ishikawa; Yuji Koike, both of Tokyo, Japan

[73] Assignee: Kabushiki Kaisha Daini Seikosha, Japan

[21] Appl. No.: 747,529

[22] Filed: Dec. 6, 1976

[30] Foreign Application Priority Data

Dec. 4, 1975 Japan ..... 50-144640
Dec. 19, 1975 Japan ..... 50-151657

[51] Int. Cl.[2] ..... G04C 3/00; G04B 19/30

[52] U.S. Cl. ..... 58/23 R; 58/50 R; 58/127 R; 235/92 EA

[58] Field of Search ..... 58/4 A, 23 R, 50 R, 58/127 R; 235/92 EA, 92 T

[56] References Cited

U.S. PATENT DOCUMENTS 3,839,856 10/1974 Dargent ..... 58/4 A

*Primary Examiner*—Edith S. Jackmon
*Attorney, Agent, or Firm*—Robert E. Burns; Emmanuel J. Lobato; Bruce L. Adams

[57] ABSTRACT

This invention provides a digital electronic timepiece for displaying the minute and seconds displays by the common display portion, particularly, minute and seconds displays are alternately displayed by said common display portion.

2 Claims, 8 Drawing Figures

FIG. 3
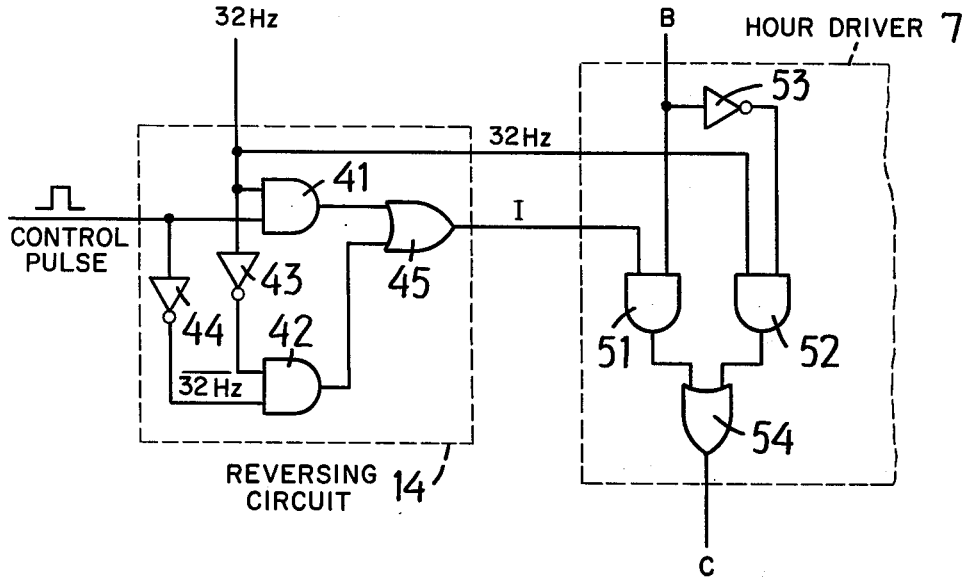
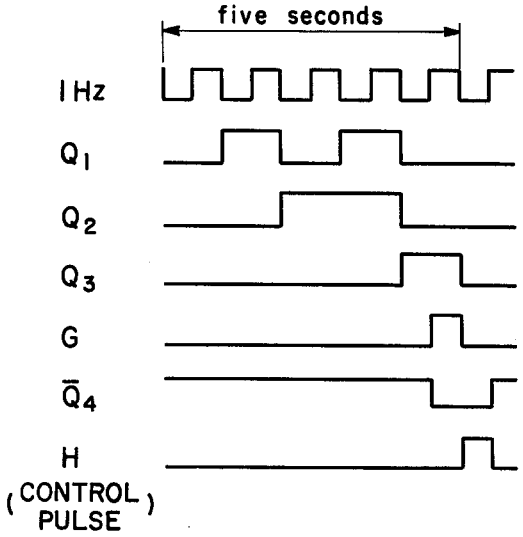
FIG. 4

FIG. 6
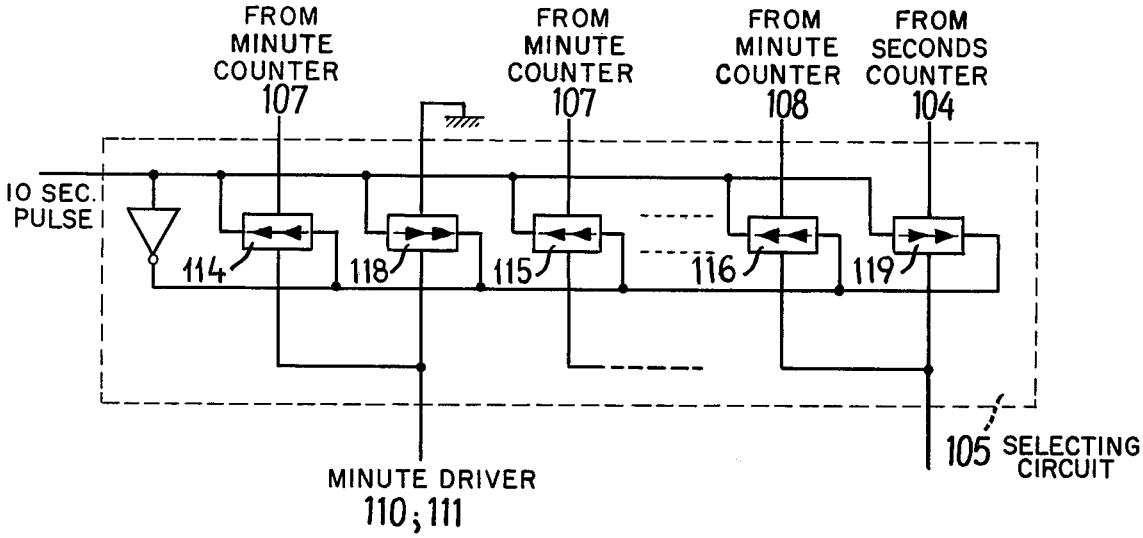
FIG. 7
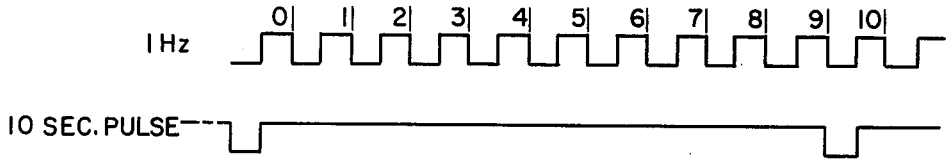
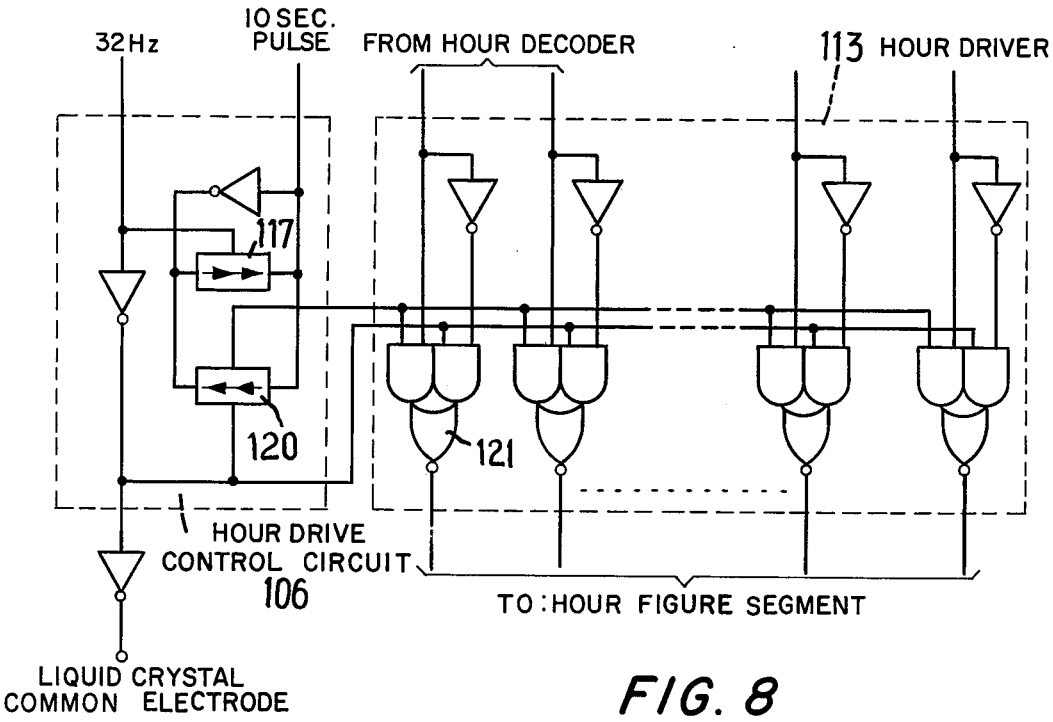
FIG. 8

DIGITAL ELECTRONIC TIMEPIECE

BACKGROUND OF THE INVENTION

This invention relates to a digital electronic timepiece for displaying the minute and seconds displays by the common display portion.

In the conventional type, a digital electronic timepiece having the minimum requisite display function, the hour and minute are displayed in the digital form, the seconds display is displayed by the flashing of the colon for separating the hour and minute. In these timepieces, since the seconds are not displayed in digital form, it way very inconvenient to acknowledge the seconds display. Particularly, we have to await until the minute display is changed for acknowledging the time error.

As the means for eliminating the above noted difficulty, it is possible to mount seconds display digits. In this type, the display device and electronic circuit become more complicated whereby the number of terminals of the display device increases, further the complication of the circuit wires is not eliminated.

As another means for eliminating the above noted drawback, the seconds display portion and the minute display portions are commonly displayed by the common display portion, and are selectively displayed by the switching operation of an outer operational switch. However, in this type, the outer operation becomes complicated; further it is necessary to mount the additional switch.

OBJECT OF THE INVENTION

The present invention aims to eliminate the above noted difficulty and insufficiency, the object of the present invention being to provide a means for displaying a seconds display of a digital electronic timepiece having only hour and minute display function by a simple modification.

A further object of the present invention is to provide a digital electronic timepiece for automatically changing the minute display to the seconds display in a certain period.

SUMMARY OF THE INVENTION

According to the present invention, there is provided a digital electronic timepiece for displaying the minute and seconds displays by a common display portion, particularly, the minute and seconds display are alternately displayed by said common display portion.

BRIEF DESCRIPTION OF THE DRAWINGS

The above mentioned and further objects, features and advantages of the present invention will become more obvious from the following description when taken in connection with the accompanying drawings, which show preferred embodiments of the present invention and wherein:

FIG. 3 shows a circuit construction of the phase reversing circuit and hour driver of being employed in FIG. 1, FIG. 4 shows a time chart for explaining the operation of said control circuit, FIG. 6 shows a selecting circuit employed in said embodiment in FIG. 5, FIG. 7 shows a time chart diagram, and FIG. 8 shows an hour drive control circuit employed in said embodiment in FIG. 5,

DETAILED EXPLANATION OF THE INVENTION

This invention relates to a digital electronic timepiece for displaying the minute and seconds displays by the common display portion.

Figure 1:
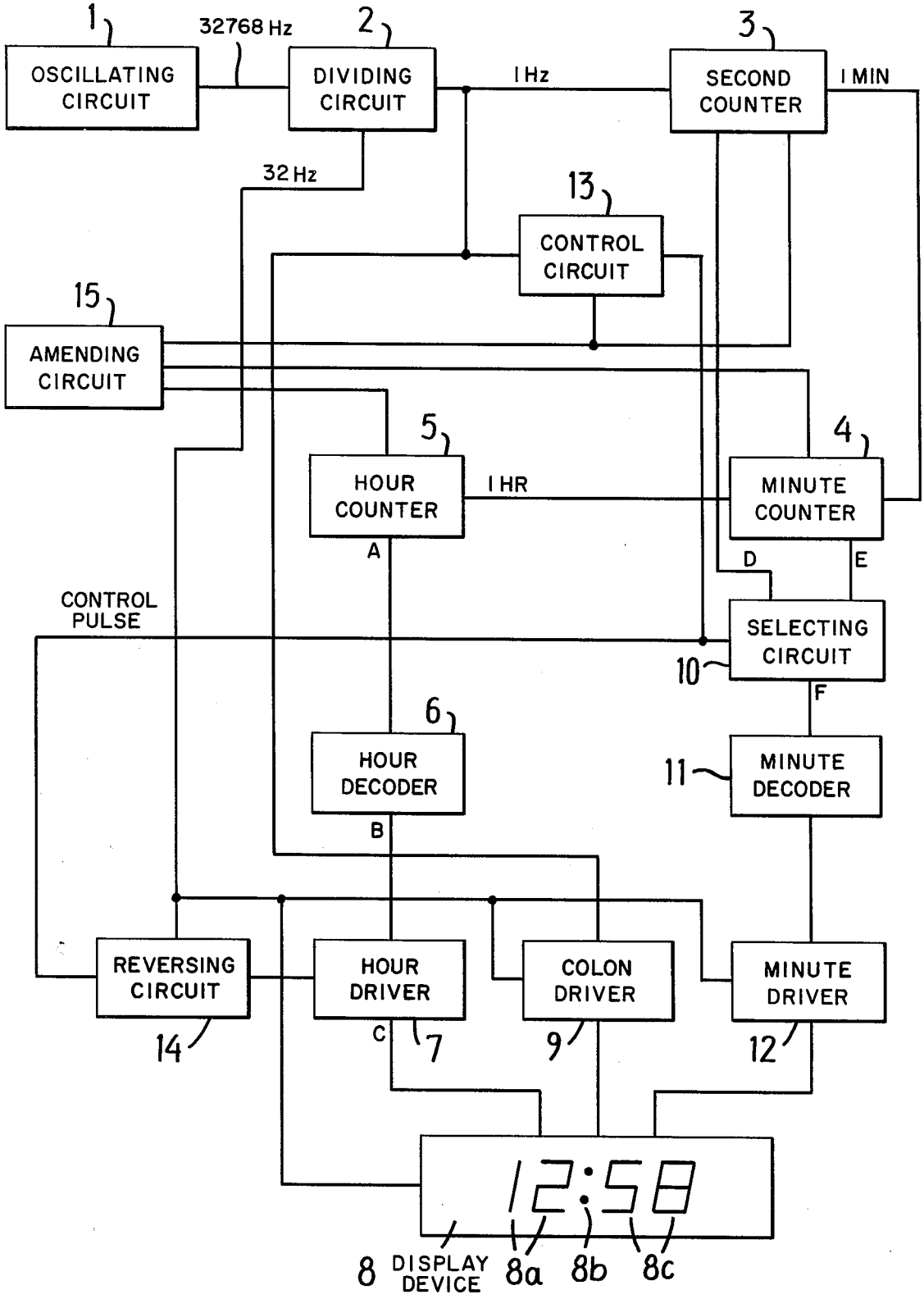
FIG. 1 shows a block diagram of one embodiment of the present invention.

Referring now to the first embodiment of the present invention accompanying drawings in which:

FIG. 1 shows a block diagram of an embodiment of the digital electronic timepiece of the present invention. A standard signal 32768 Hz from an oscillating circuit 1 is divided to 1Hz by a dividing circuit 2, and is applied to a seconds counter 3. One minute signal from said seconds counter 3 is applied to a minute counter 4, one hour signal from said minute counter 4 is applied to a hour counter 5. A display output "A" of said hour counter 5 is applied to an hour decoder 6, an output "B" of said decoder 6 is applied to an hour driver 7, the output "C": of said hour driver 7 is applied to a display device 8 whereby the hour display FIG. 8*a* is driven. As the display device 8, a liquid crystal display, LED-display and a fluorescent lamp are; a liquid crystal display is employed in this embodiment. Said 1Hz signal drives a colon display 8*b* via a colon driver 9.

A selecting circuit 10 selects one of the display outputs D and E of second and minute counters 3 and 4, and applies the output "F" to said minute decoder 11. The output of said minute decoder 11 drives the minute display FIG. 8*c* of the display device 8 via a minute driver 12. A control circuit 13 receives a 1Hz signal, and generates a control pulse having a certain period, and controls said selecting circuit 10 and a phase reversing circuit 14. A 32Hz signal generated by said dividing circuit 2 is applied to the colon driver 9, the minute driver 12, a common terminal of said display device 8 and the phase reversing circuit 14. Said phase reversing circuit 4 applies the 32Hz signal or $\overline{32Hz}$ signal to the hour driver 7.

An amending circuit 15 is an amending circuit of the display contents, and is able to apply the amending signal to said seconds counter 3, minute counter 4, hour counter 5 and control circuit 13.

Figure 2:
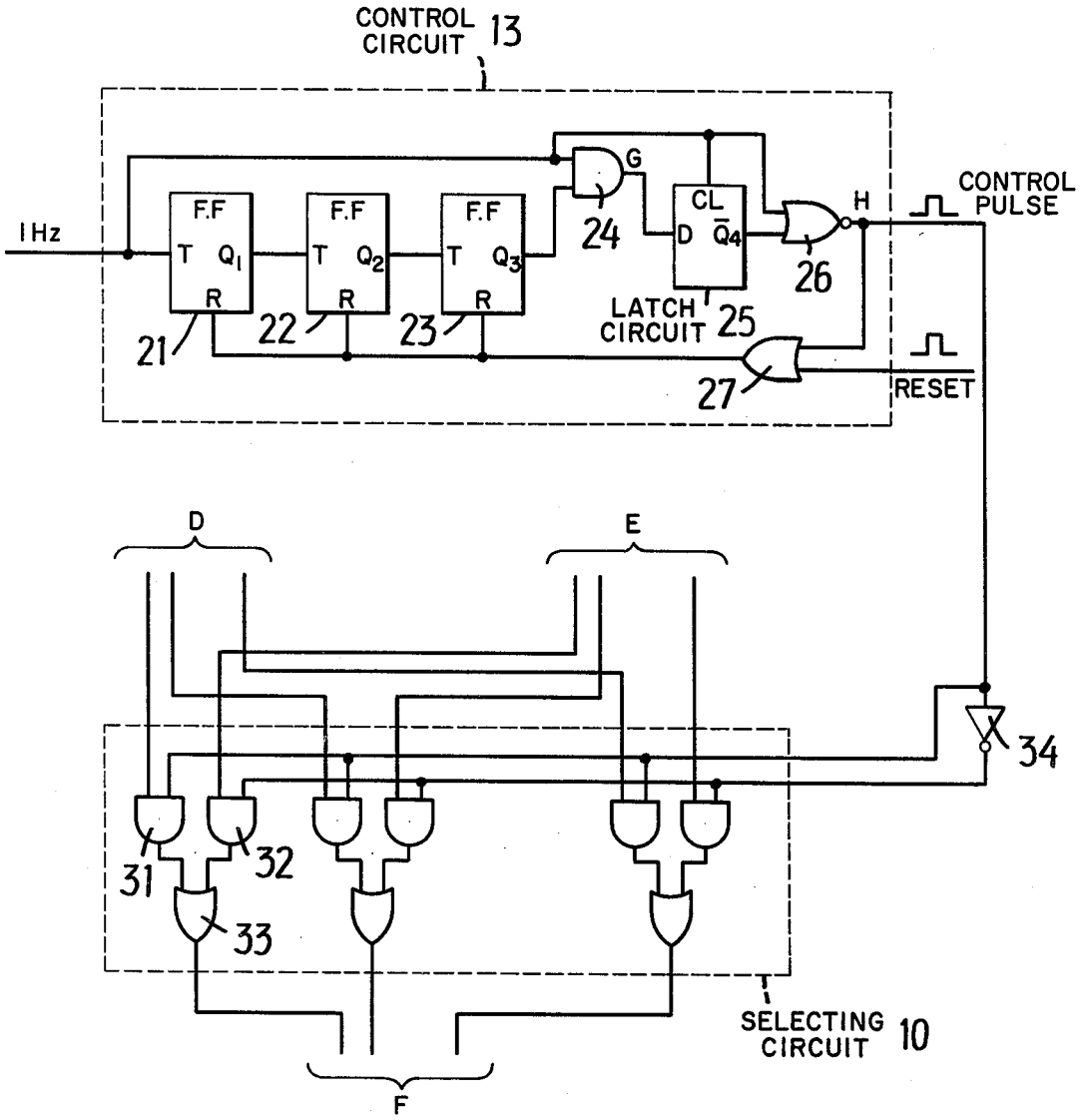
FIG. 2 shows a circuit construction of the control circuit and selecting circuit of being employed in FIG. 1.

Referring now to the construction of main portion of the present invention illustrated in the accompanying drawings in which:

in FIG. 2, said control circuit 13 is a five-counting counter composed of three T-type flip flops (referred to as F.F) 21, 22 and 23, AND-gate 24, latch circuit 25, NOR-gate 26 and OR-gate 27. A 1Hz signal is applied to the input "T" of F.F21, FF22 and 23 in sequence and connected, the output $Q_3$ of F.F23 and the 1Hz signal are applied to AND-gate 24. The output "G" of AND-gate 24 is connected to the input "D" of latch circuit 24; the 1Hz signal is applied to the clock input "CL" of said latch circuit 25. The output $\overline{Q_4}$ of said latch circuit 25 and the 1Hz signal are applied to the input of NOR-gate 26, the output "H" of which is generated as the control pulse and is connected to the reset input "R" of F.F21, 22 and 23 via OR-gate 27.

Said OR-gate 27 is mounted to enable resetting of F.F21, 22 and 23 by an outer signal; a seconds reset signal of said amending circuit 15 is applied to one input terminal "RESET" by the outer operation.

In said selecting circuit 10 of FIG. 2, a display output "D": of said seconds counter 3 and the control pulse are applied to AND-gate 31; a display output E of said minute counter 4 and a control pulse are applied to AND-gate 32 via the inverter 34. The outputs of AND-gates 31 and 32 are applied to OR-gate 33; the output "F" is applied to said minute decoder 11. In the above noted circuit, only the three signals D, E and F are indicated without other signals; further only three pair of AND-gates and OR-gates are indicated.

In the phase reversing circuit of FIG. 3, a 32Hz signal and the control pulse are applied to AND-gate 41.

The inverted control pulse inverted by the inverter 44 and the 32Hz signal inverted by the inverter 43 are applied to AND-gate 42. The outputs of AND-gates 41 and 42 are applied to OR-gate 45, thereby generating the output "I" to the hour driver 7. In said hour driver 7, the output "B" of said hour decoder 6 and the output "I" of said phase reversing circuit 14 are applied to AND-gate 51; the inverted output "B" of said hour decoder 6 inverted by the inverter 53 the 32Hz signal are applied to AND-gate 52. The outputs of AND-gates 51 and 52 are applied to OR-gate 54, whereby the output "C" is generated to said display device 8. In FIG. 3, only the input and output B and C of said hour driver 7 and indicated; however, the same circuits of corresponding to the segment number of said hour display are likewise mounted.

Referring now to the operational construction of the embodiment of the present invention accompanying time chart of FIG. 4:

FIG. 4 shows the time chart for explaining the operation of said control circuit 13; the outputs $Q_1$, $Q_2$ and $Q_3$ of F.F21, 22 and 23 are "LOW" level. Said $Q_3$ build up according to the down drop of the fourth of 1Hz signal; the output "G" of AND-gate 24 becomes the "HIGH" according the fifth pulse of 1Hz signal. If the latch circuit 25 receives the data signal via the input "D" according to the build-up of the clock input "CL", the output $\overline{Q}_4$ changes from "HIGH" to "LOW" according to the build up of the fifth pulse of the 1Hz signal, and changes from "LOW" to "HIGH" according to the build-up of the sixth pulse of the 1Hz signal.

The output $\overline{Q}_4$ of said latch circuit 25 and the 1Hz signal are applied to NOR-gate 26; the output "H" builds up from "LOW" to "HIGH" according to the down drop of fifth pulse, and changes to "LOW" according to the build up of sixth pulse of 1Hz signal, whereby a pulse signal is generated from the output point "B". Said pulse signal is generated as the control pulse, and is applied to the inputs "R" of F.F21, 22 and 23 whereby they are reset. Therefore, said control circuit 13 is operated as a five counting counter, and generates the control pulse having the build up time of 0.5 sec.

Referring now to the operation of said selecting circuit 10 of FIG. 2:

When the control pulse is in "LOW" state, AND-gate 31 is closed whereby AND-gate 32 is opened, then the input signal "E" is generated from the output "F". On the contrary, when the control pulse is in "HIGH" state, AND-gate 31 is opened, whereby AND-gate 32 is closed, then the input signal "D" is generated from the output "F". Therefore, when the control pulse is in "LOW" state, the display output "E" of the minute counter 4 is applied to the minute decoder 11, whereby the minute display is displayed by the minute display FIG. 8c.

When the control pulse is in "HIGH" state, the display output "D" of the seconds counter 3 is applied to the minute decoder 11, whereby the seconds display is displayed by the minute display FIG. 8c.

Referring now to the operation of the phase reversing circuit 14 of FIG. 3:

When the control pulse is in "LOW" state, AND-gate 41 is closed; whereby AND-gate 42 is opened, then a 32Hz signal is generated from the output "I". On this occasion, in the hour driver 7, AND-gate 51 is opened and AND-gate 52 is closed when the input "B" is in "HIGH" state, whereby the input signal "I" namely 32Hz signal is generated, and the hour display is displayed by the display device 8.

When the input "B" is in "LOW" state, the open and closed condition of AND-gates 51 and 52 are reversed against the above noted switching condition, a 32Hz signal is generated from the output terminal "G", the hour display is not displayed by the display device 8.

Further, when the control pulse is in "HIGH" state, AND-gate 41 is opened and AND-gate 42 is closed, whereby a 32Hz signal is generated from the output terminal "I". On this occasion, a 32Hz signal is applied to AND-gates 51 and 52, 32Hz signal is generated from the output "C" in spite of the "HIGH" and "LOW" condition of the input "B", all of the digits are not operated and then the display is not displayed.

Referring now to the displaying operation of the first embodiment of the present invention:

The outer reset signal being the same as that applied to the second counter 3 is applied to the input, "RESET" of said control circuit 13; the counting is started at the same time of the second counter 3. When the control pulse is in "LOW" state, the hour and minute are displayed by the display device 8.

The control pulse becomes to "HIGH" state during 0.5 sec in 12 times/1 minute by the cyclic term from 0 sec to 5 sec, whereby the seconds displays, for example, 00, 05, 10 . . . 50, 55 are sequentially displayed during 0.5 sec respectively. The hour display is not displayed during the time when the seconds display is displayed, whereby it is possible to distinguish the minute and second when the minute and seconds displays are coincided each other namely 00 minutes 00 seconds, 05 minutes 05 seconds, 10 minutes 10 seconds . . . 55 minutes 55 seconds; therefore, the second display is acknowledged during the periods the hour display is not displayed.

In this embodiment of the present invention, the period of the seconds display is determined for 5-seconds and the display time is determined for 0.5 sec, however, it is possible to change the period of the seconds display and the display time.

According to the present invention, the seconds display and the minutes display are alternately automatically displayed by the preferable period.

Further, it is possible to add the display system of the present invention to the conventional digital electronic timepiece capable of only displaying the hour and minute.

Figure 5:
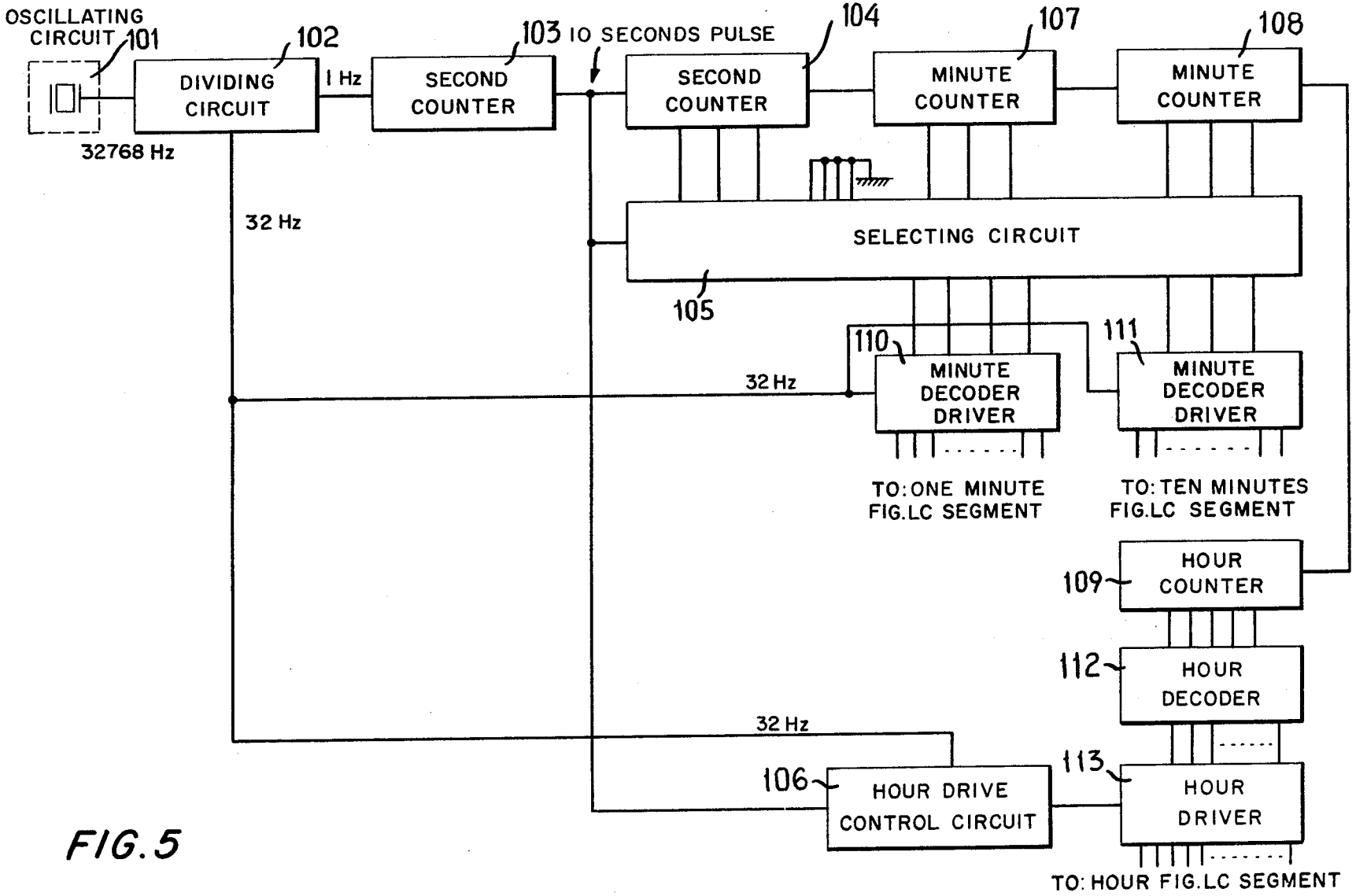
FIG. 5 shows a block diagram of a second embodiment of the present invention.

Referring now to the second embodiment of the present invention accompanying drawings in which:

FIG. 5 shows a block diagram of the second embodiment of the digital electronic timepiece of the present inveniton, A liquid crystal display is employed as a display means, further CMS-IC is employed as a drive circuit.

A standard signal, 32768Hz, generated from an oscillating circuit 101 is divided to 1Hz signal by a dividing circuit 102, said 1Hz signal is applied to a seconds counter 103.

Ten seconds pulse generated from said seconds counter 103 is applied to another seconds counter 104, a selecting circuit 105 and a hour drive control circuit 106. The carry output signal of said seconds counter 104 is applied to a minute counter 107, the carry output of said minute counter 107 is applied to another minute counter 108, the carry signal of said minute counter 108 is applied to an hour counter 109.

The display outputs of said seconds counter 104, minute counter 107 and other minute counter 108 are applied to said selecting circuit 105, the output of said selecting circuit 105 is applied to minute decoder driver 110 and 111.

The output of said hour counter 109 is applied to a hour decoder 112; the output of said hour decoder 112 is applied to another driver 113 controlled by said hour drive control circuit 106.

A 32Hz signal for driving a liquid crystal is generated from the middle stage of said dividing circuit 102, and is applied to said minute decoder driver 110 and 111, and is applied to said hour drive control circuit 106.

In FIG. 5, the seconds display is displayed every ten seconds, "0" display is dislayed by the one minute figure during the seconds display condition.

Namely, the contents of said one minute figure counter are maintained at "LOW" level; the input of a transmissiongate 118 in said selecting circuit 5 is maintained at "LOW" level, whereby the output of said seconds counter 104 is displayed by the ten minutes figure, namely the seconds display of 00, 10 . . . 50 etc are sequentially displayed. The explanation of the switch mechanism is omitted.

Referring now to the operation of the embodiment of the present invention illustrated in the accompanying drawings in FIG. 5, 6, 7 and 8:

FIG. 7 shows a time chart diagram, said ten seconds pulse is the sequential pulse of ten seconds period as indicated in FIG. 7, and is dropped to "LOW" level at the starting point of ten seconds, and is changed to "HIGH" level at the latter half of ten seconds. Namely, said ten seconds pulse becomes "LOW" level during 0.5 second in every ten seconds. Further, said ten seconds pulse is applied to said seconds counter 104, said counters are operated by the down point of said pulse.

In FIG. 6 and 8, in the condition in which the ten-seconds pulse is at "HIGH" level namely from the latter half of 0-second to ten seconds, the transmission gates 114, 115 and 116 of said selecting circuit 105 are maintained to ON-state, the output of said minute counters 107 and 108 are applied to said minute decoder driver 110 and 111, whereby the minute display is displayed. At this time, in FIGS. 7 and 8, when said ten seconds pulse is at "HIGH" level, said transmission-gate 117 is maintained in ON-state; further 32Hz and 32Hz signals are applied to said hour driver 113 whereby the hour figure is displayed.

Said seconds counter 104 is operated when said ten seconds pulse becomes to "LOW" level; the contents of said seconds counter 104 is set to "1". Instantaneously, said transmission gates 118 and 119 in FIG. 6 becomes to ON-state, the output of said second counter 104 is applied to said ten-minutes figure decoder driver 111, the contents of being same to "0" of said minute counter 107 namely "LOW"-level is applied to said one minute figure decoder driver 110. "1" of said seconds counter 104 is displayed to the display device of being maintained to the normal minute display, further "0" is displayed to the one minute figure, whereby ten-seconds is displayed during 0.5 second. Then the normal minute display is displayed at the latter half of ten seconds.

When said ten-seconds pulse become to "LOW" level, said transmission gate 120 becomes to state, 32Hz and 32Hz signals are applied to said hour driver 113, the output of NOR-gate 121 is maintained to 32Hz. Therefore, the hour figure display is extinguished.

According to the repeat operation of the above noted operation, the contents of said second counter 104 is "2" when twenty-seconds have elapsed, further the contents of said second counter 104 is "3" when thirty-seconds have elapsed. "0" display is always displayed to the one minute figure digit when the seconds display is displayed, and the hour figure is extinguished when the seconds display is displayed.

According to the present invention, the time display of hour minute and second is completely displayed by the minimum segments in an electronic timepiece having no digital display of the seconds display, further the hour figure is extinguished when the seconds display is displayed, whereby, for example, ten minutes and twenty minutes are preferably switched to ten-seconds and twenty seconds, therefore minute and second are easily clarified.

Further, the seconds display is intermittently displayed in every ten seconds, whereby it is very convenient to detect the seconds error by the time alarm services operated every ten seconds. Furthermore, it is possible to operate the seconds display by a preferable period other than ten seconds period.

What we claim is:

1. A digital electronic timepiece comprising in combination; an oscillating circuit for generating a time standard signal, a dividing circuit for dividing said time standard signal to produce a drive pulse of selected frequency, second, minute and hour counters connected serially to each other and receiving and counting said drive pulse to provide counts of seconds, minutes and hours respectively, first display means for digitally displaying said hour count, a first decoder driver connected between said hour counter and said hour display means, second display means for alternatively digitally displaying said seconds count and said minutes count, a second decoder driver for said second display means, a selecting circuit for alternately connecting said seconds counter and said minutes counter with said second decoder driver, and a control circuit receiving pulses from said driving circuit and controlling said selecting circuit periodically to connect said second decoder driver alternately with said seconds counter and said minutes counter to display the seconds count and the minutes count alternately a selected intervals by said second display means.

2. A digital electronic timepiece according to claim 1, in which said control circuit also controls display of said hours count by said first display means to display said hours count while said minutes count is displayed by said second display means but not to display said hours count while said seconds count is displayed by said second display means.

* * * * *